United States Patent [19]

Koseki et al.

[11] 4,232,536

[45] Nov. 11, 1980

[54] AGITATOR-TYPE WASHING MACHINE

[75] Inventors: Wasuke Koseki, Moriguchi; Kunihito Mori, Toyonaka; Hideo Obata, Ibaraki; Yoshikazu Shinchi, Osaka, all of Japan

[73] Assignee: Matsushita Electric Industrial Co., Ltd., Kadoma, Japan

[21] Appl. No.: 35,268

[22] Filed: May 1, 1979

[30] Foreign Application Priority Data

May 16, 1978 [JP] Japan ..... 53-058422

[51] Int. Cl.[3] ..... D06F 13/02

[52] U.S. Cl. ..... 68/12 R; 68/23.7

[58] Field of Search ..... 68/23 R, 23.6, 23.7, 68/12 R

[56] References Cited

U.S. PATENT DOCUMENTS

| | | | |
|---|---|---|---|
| 2,807,951 | 10/1957 | Gerhardt et al. | 68/23.7 |
| 3,194,032 | 7/1965 | Von Brimer | 68/23 R |
| 3,248,908 | 5/1966 | Pope | 68/23.7 X |
| 3,324,690 | 6/1967 | Button | 68/23.7 |
| 3,914,963 | 10/1975 | Brimer | 68/23.7 |

*Primary Examiner*—Philip R. Coe

*Attorney, Agent, or Firm*—Cushman, Darby & Cushman

[57] ABSTRACT

An agitator-type washing machine comprising an axial-airgap motor and a planetary reduction gear means, wherein a reciprocating motion of the axial-airgap motor is transmitted to an agitator via the reduction gear means in a washing action thereby making use of a high rotational speed, hence large torque and high efficiency of the axial-airgap motor.

7 Claims, 20 Drawing Figures

WASHING ACTION

SPINNING ACTION

AGITATOR-TYPE WASHING MACHINE

BACKGROUND OF THE INVENTION

1. Field of the Invention:

This invention relates to an agitator-type washing machine.

2. Description of the Prior Art:

An induction motor and a reduction and oscillating machanism were usually used in the conventional agitatortype washing machine. Rotary motion of an electric motor is translated into the reciprocating motion by means of an oscillating mechanism comprising a cam and a crank, and so on. However, such conversion mechanism is subject to problems arising from dead points such as noise, shocks and abrasion. It is necessary to use extremely precisely fabricated components for the conversion mechanism in order to decrease such noise and shocks. This leads to high production costs. On the other hand, the speed of the reciprocating motion of the conventional agitator-type washing machine can be varied by changing pole connection of the electric motor. However, it is not continuously variable, but the selection of the speed is limited to a gentle or a vigorous washing action at the selection of the operator.

It has been proposed to employ an axial-airgap motor comprising stators on both sides of a disk-shaped rotor and being directly connected with a washing shaft. A washing machine utilizing such axial-airgap motor is disclosed in, for example U.S. Pat. No. 3,194,032 for Von Brimer. But such washing machine has the following problems. It is necessary to make the rotary speed of the axial-airgap motor extremely low in the washing action. The efficiency of the axial-airgap motor is extremely low due to the reciprocating motion of the axial-airgap motor repeatedly made at a short time. Besides, it is necessary to use a large capacity motor in order to generate large torque necessary for the direct drive in the washing action.

SUMMARY OF THE INVENTION

The present invention purports to provide an agitator-type washing machine utilizing an axial-airgap motor.

BRIEF DESCRIPTION OF THE DRAWINGS

FIG. 1(*b*) is an enlarged view of principal mechanical part of the agitator-type washing machine of FIG. 1(*a*).

FIG. 1(*c*) and 1(*d*) are views illustrating torque transmission in a washing action and a spinning action.

FIG. 5(*b*) is a sectional view of the assembled coupling means.

FIG. 13(*b*) is a graph showing a relationship between the rotary angle of the agitator and degree of damages of the washing objects.

DESCRIPTION OF THE PREFERRED EMBODIMENT

An agitator-type washing machine in accordance with the present invention comprises an axial-airgap motor for making a washing action when coupled by means of a reduction means and making a spinning (dehydrating) action when coupled by means of a clutch means, a washing shaft journalled coaxially in a spinning shaft and connected with a shaft of the axialairgap motor through the reduction means, therein the spinning action to remove water from washing objects is made by a continuous one direction rotation of the spinning shaft through the clutch means, and the washing action is made by a reciprocating motion of the washing shaft through the reduction means.

Figure 1:
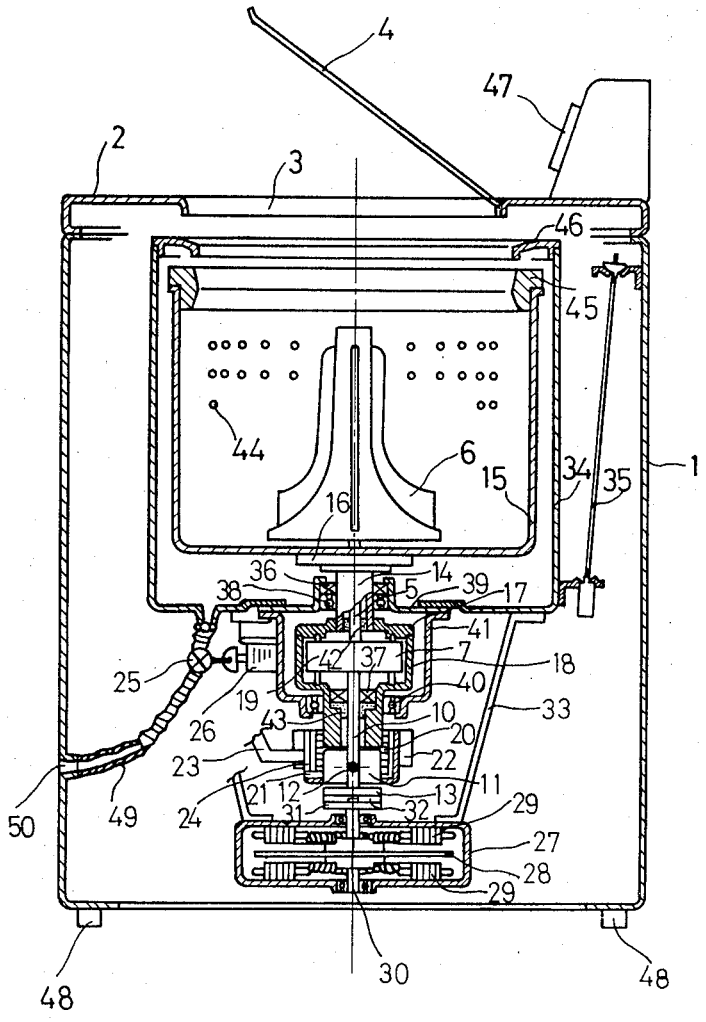
FIG. 1(*a*) is a sectional elevation view of a agitator-type washing machine in accordance with the present invention.
Figure 1:
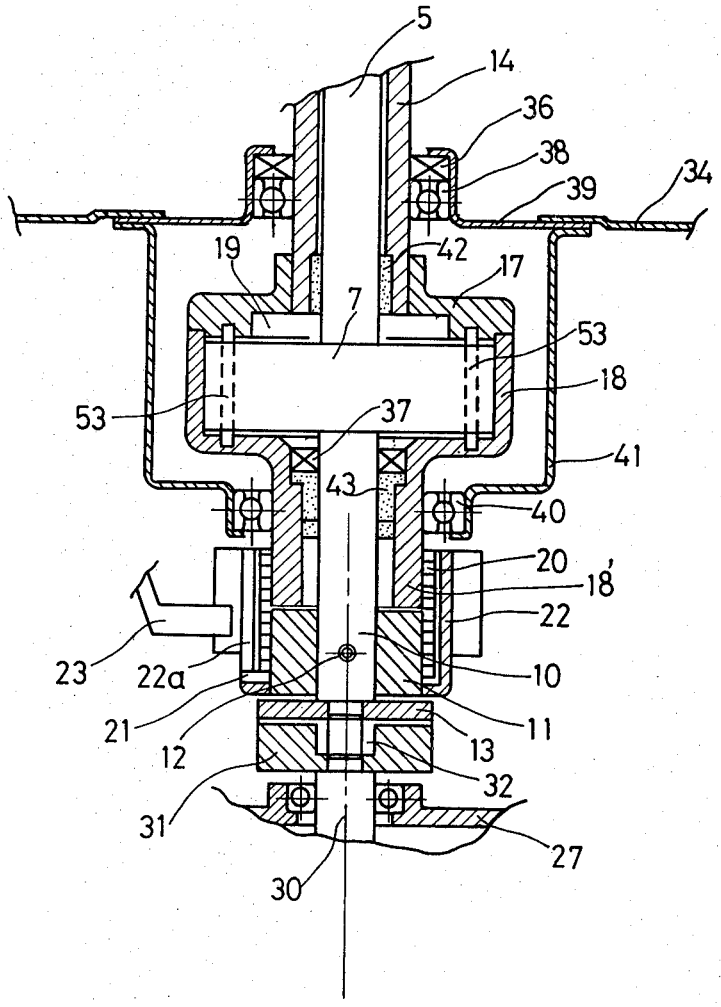
Figure 1C:
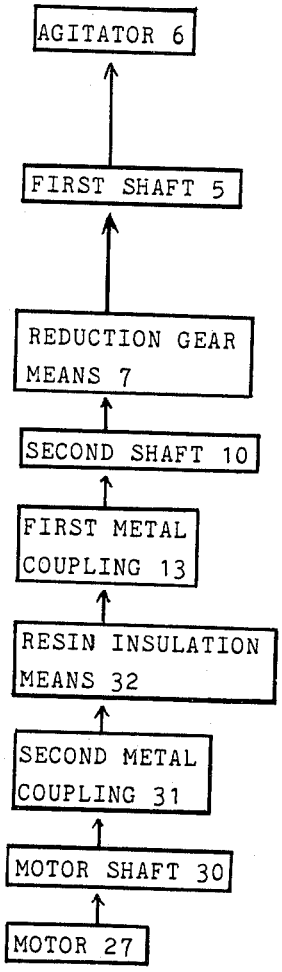
Figure 1D:
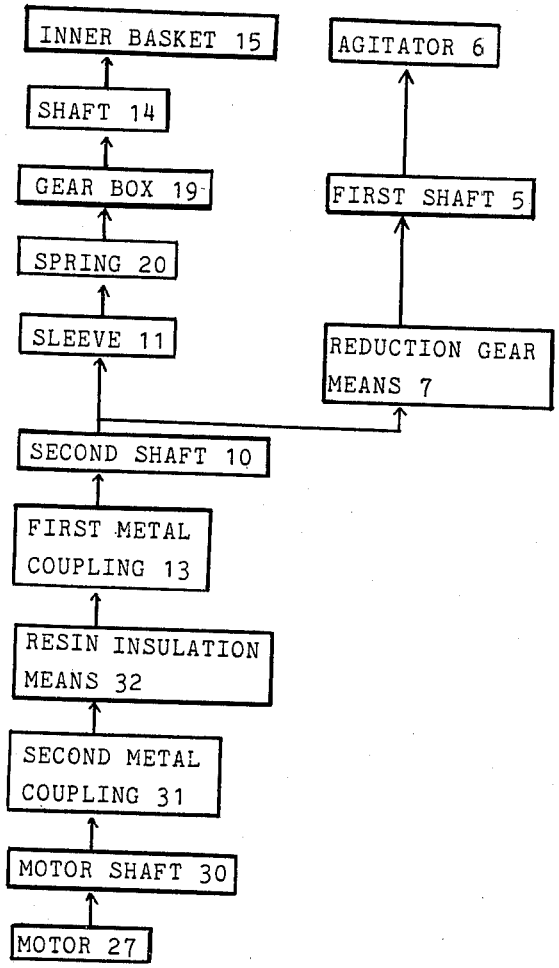

A prefered embodiment in accordance with the present invention is elucidated by reference to the following detailed description, when considered in conjunction with the accompanying drawings. FIG. 1(*a*) shows an agitator-type washing machine in accordance with the present invention. FIG. 1(*b*) is an enlarged view of principal mechanical parts of the same. The agitator-type washing machine comprises an outer frame 1, an upper frame 2 having an opening 3 in the center thereof for putting the washing objects in a washing space, a cover 4 for closing the opening 3, and mechanical parts for imparting a washing and a spinning action to the washing objects. The principal mechanical parts are shown in FIG. 1(*b*).

A reciprocating agitator 6 is mounted on one end of a first shaft 5 for the washing action. The other end of the first shaft 5 for the washing action is connected with an output part 8 (shown in FIG. 6) of a reduction gear means 7. One end of an input shaft 10 is connected with a sun gear 9 of the reduction gear means 7. A sleeve 11 for a clutch means 24 is fixed by a fixing means 12 such as a spring cotter to the other end of the input shaft 10. A first metal coupling 13 engages with the tip of the input shaft 10 under the sleeve 11 for the clutch means 24. The first shaft 5 for the washing action, the sun gear 9 of the reduction gear means 7 and the input shaft 10 are precisely constructed in such a manner that their centers of rotation lie on a straight line thereby transmitting the washing action to the reciprocating agitator 6.

A washing and spinning basket 15 (hereinafter referred to inner basket) is supported by a shaft 14 for the spinning action by means of a flange 16 fixed to the shaft 14 for the spinning action under and at the center of the inner basket 15. The other end of the shaft 14 for the spinning action is firmly fixed to a first portion 17 of a gear box 19. The gear box 19 is composed of the lid-shaped first portion 17 and a pot-shaped second portion 18, and encases lubricating oil therein. A lower part 18' of the second portion 18 of the gear box 19 has an outer diameter almost equal to that of the sleeve 11 for the clutch means 24. The lowermost face of the second portion 18 of the gear box 19 and the uppermost face of the sleeve 11 for the clutch means 24 are constructed so as to have a thin gap inbetween.

A spring 20 shaped like a coil is disposed so as to encircle the lower part 18' of the second portion 18 of the gear box 19 and the sleeve 11 for the clutch means 24. The gear box 19 and the shaft 14 for the spinning action are precisely constructed in such a manner that their axes of rotation lie on the same straight line as that of the axes of rotation for the first shaft 5 for the washing action, the sun gear 9 of the reduction gear means 7 and the input shaft 10 thereby transmitting the spinning action of a high speed to the inner basket 15 in the spinning action cycle.

The motor 27 is suspended by plural metal fixtures 33. A tub 34 is installed outside the inner basket 15. Plural vibration absorbing means 35 support the tub 34 and absorb the vibrational movement of the tub 34 in the spinning action. A water-tight oil seal 36 is for preventing leak of water from the tub 34. An oil seal 37 is provided to prevent oil leak of the lubricating oil encased in the gear box 19. A ball bearing 38 is disposed in a first casing 39 and journals the shaft 14. A ball bearing 40 is disposed in a second casing 41 and journals the lower part 18' of the second portion 18 of the gear box 19. The ball bearings 38 and 40 are specially designed to give a predetermined small friction of the shaft 14. A sleeve 42 is journalled between the shaft 14 for the spinning action and the first shaft 5 for the washing action. A sleeve 43 with collar is journalled between the lower part 18' of the second portion 18 of the gear box 19 and the input shaft 10.

The inner basket 15 is perforated to permit passage of water through several holes 44 formed on the wall thereof. A ring 45 is disposed on the top of the inner basket 15 to obtain a well-balanced rotational motion of the inner basket 15 during the spinning action. A cover 46 is disposed on the top of the tub 34 to prevent the scattering of water and danger of touching the spinning basket. The agitator-type washing machine in accordance with the present invention further comprises a timer 47, undercarriages 48, a drain hose 49 and a drainage opening 50. The drain valve 25 is provided in the midway of the drain hose 49. When the magnet 26 for the drain valve 25 is actuated to open the drain valve 25, the water inside the tub 34 and the inner basket 15 drains away from the drainage opening 50 disposed at the lower part of the outer frame 1.

Figure 2:
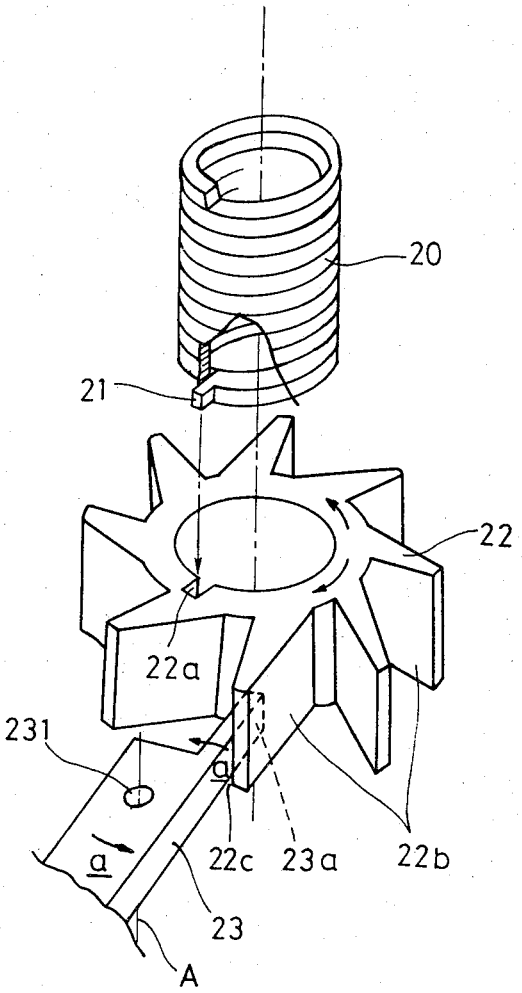
FIG. 2 is a perspective view of a clutch means for changing-over the operation of the agitator-type washing machine between a washing action and a spinning (for dehydrating) action.

FIG. 2 shows principal parts of the clutch means 24 comprising the spring 20. A pawl 21 having an outward projection is formed at the lowest end of the spring 20 as shown in FIG. 2. A boss 22 having triangular teeth around it covers spring 20 in such a manner that the pawl 21 is fitted in a groove 22*a* slotted at the inner face of the boss 22.

The clutch means 24 comprising the spring 20, the pawl 21, the boss 22 and a clutch lever 23 works in different ways in the washing action and the spinning action. FIG. 1(*c*) and FIG. 1(*d*) are diagrams showing transmission of the rotational motion of an axial-airgap motor 27 (hereinafter referred to motor) in the washing action and the spinning action, respectively. As shown in FIGS. 1(*c*) and 1(*d*), the rotational movement of the first metal coupling 13 is not transmitted to the gear box 19 in the washing action, whereas the rotational movement thereof is transmitted to the gear box 19 by means of the spring 20 thereby rotating the inner basket 15 in the spinning action. Such operations of the clutch means 24 are elucidated in detail in the following by referring to FIG. 1(*b*), and FIG. 2 and FIG. 3.

The boss 22 is shaped like a toothed wheel having several teeth 22*b* and is engaged with the clutch lever 23 at its space 22*c* between the teeth 22*b*. The clutch lever 23 is pivotally secured by a pin (not shown) inserted in a hole 231 and rotatable in a direction shown by arrows a around an axis indicated by a line A. The rotational action of the clutch lever 23 is interlocked with a magnet 26 for a drain valve 25. In the spinning action, the magnet 26 for the drain valve 25 actuates the drain valve 25 and the clutch lever 23 is pivotted in the direction shown by arrows a in such a manner that a tip 23*a* of the clutch lever 23 is completely withdrawn from the teeth 22*b*. On the other hand, the magnet 26 for the drain valve 25 is not actuated and the tip of the clutch lever 23 is engaged with the space 22*c* between the teeth 22*b* thereby interrupting the movement of the boss 22.

Figure 3:
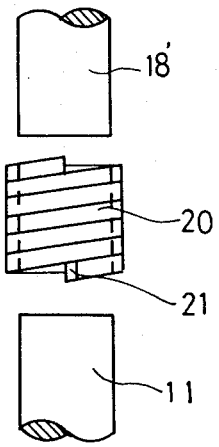
FIG. 3(*a*), FIG. 3(*b*) and FIG. 3(*c*) are views illustrating the operational principle of the clutch means of FIG. 2.
Figure 3:
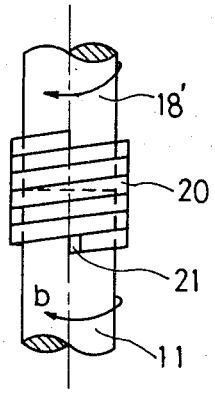
Figure 3:
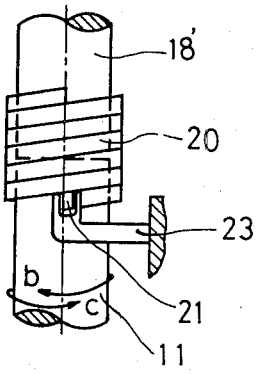

FIG. 3(*a*) schematically shows the spring 20 with the pawl 21 before installing therein the sleeve 11 for the clutch means 24 and the lower part 18' of the second portion 18 of the gear box 19. FIG. 3(*b*) schematically shows the spring 20 in the spinning action. Along with the rotational movement of the sleeve 11 for the clutch means 24 in a direction indicated by an arrow b, the boss 22 (not shown in FIGS. 3(*a*)-(*c*) rotates a little due to the frictional force thereby making the spring 20 bind the sleeve 11 and the lower part 18' of the second portion 18 of the gear box 19. Therefore, the rotational movement of the sleeve 11 for the clutch means 24 is transmitted to the lower part 18' of the second portion 18 of the gear box 19. FIG. 3(*c*) schematically shows the spring 20 in the washing action. The tip 23*a* of the clutch lever 23 is disposed at the space 22*c* between the teeth 22*b* of the boss 22 thereby preventing the movement of the boss 22. When the sleeve 11 for the clutch means 24 rotates in the direction indicated by the arrow c, the rotational movement of the sleeve 11 loosens the spring 20. Accordingly, no transmission of the rotational movement of the sleeve 11 is made to the lower part 18' of the second portion 18 of the gear box 19. On the other hand, when the sleeve 11 for the clutch means 24 rotates in the direction indicated by the arrow b under a clamping of the pawl 21, the sleeve 11 slips inside the spring 20. The spring 20 does not bind the sleeve 11 and accordingly no transmission of the rotational movement of the sleeve 11 is made to the lower part 18' of the second portion 18 of the gear box 19, either. The abovementioned operation of the spring 20 is controlled by the clutch lever 23 in accordance with the operation of the washing machine in the washing action and the spinning action.

Figure 4:
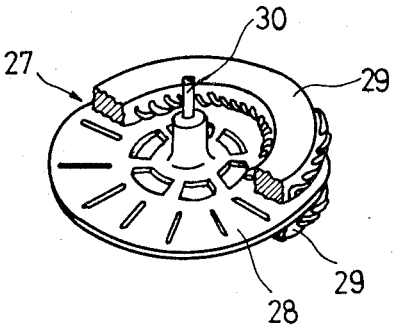
FIG. 4 is a perspective view of principal parts of a motor used for the agitator-type washing machine in accordance with the present invention.
Figure 5:
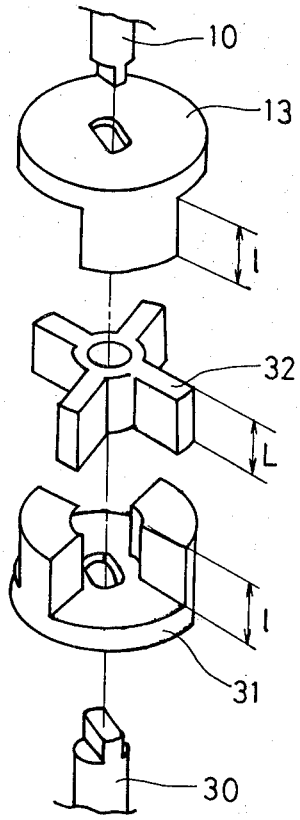
FIG. 5(*a*) is an exploded view showing a dismantled coupling means used for the agitator-type washing machine.
Figure 5:
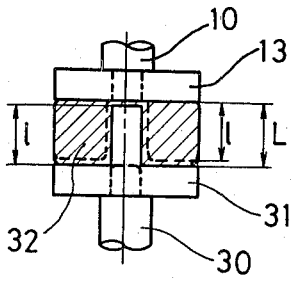

FIG. 4 is an exploded perspective view showing principal parts of an axial-airgap motor 27 (hereinafter referred to motor). The motor 27 is a kind of induction motor and comprises annular stators 29 on both sides of a rotor 28 in the form of a flat annular disk. The rotor 28 faces the stators 29 with flat air gaps in the axial directions. A motor shaft 30 is fixed at the center of the rotor 28. FIG. 5(*a*) shows a dismantled coupling means and FIG. 5(*b*) shows the assembled state of the same. The coupling means comprises a second metal coupling 31, a resin insulation means 32 of elasticity and the first metal coupling 13. The uppermost tip of the motor shaft 30 is engaged with the second metal coupling 31. The first metal coupling 13 and the second metal coupling 31 having concavo-convex parts are shaped in the form shown by FIG. 5(*a*). They are coupled with each other engaging via the cross-shaped resin insulation means 32 between the concavo-convex parts. The rotational movement of the motor shaft 30 is transmitted to the input shaft 10 through the coupling means comprising the second metal coupling 31, the resin insulation means 32 and the first metal coupling 13.

Figure 6:
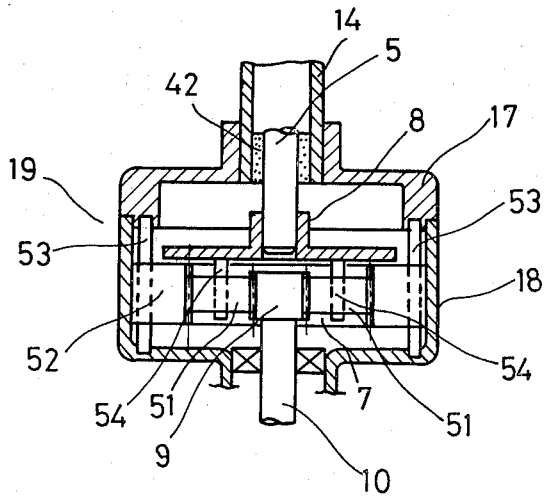
FIG. 6 is a sectional view of a mechanical part including a reduction gear used for the agitator-type washing machine.

FIG. 6 is an enlarged cross sectional view of the gear box 19, within which a compact planetary gear mechanism is encased as the reduction gear means 7. The sun gear 9 is disposed at the top of the input shaft 10. Planet gears 51 possess the same number of teeth as the sun gear 9 and engage with an annular-shaped internal gear 52.

Pins 53 for fixing the internal gear 52 are supported by the first portion 17 and the second portion 18 of the gear box 19. Accordingly, the internal gear 52 is in the fixed relation to the shaft 14 for the spinning action. Planetary gear shafts 54 rotationably support the planetary gears 51 and are fixed to the output part 8 of the reduction gear means 7. The speed of the rotary motion of the input shaft 10 is reduced by the reduction gear means 7. Torque generated by the rotary motion of the input shaft 10 is multiplied by the planetary gear mechanism thereby generating large torque at the output part 8 of the reduction gear means 7 and rotating the first shaft 5.

Figure 7:
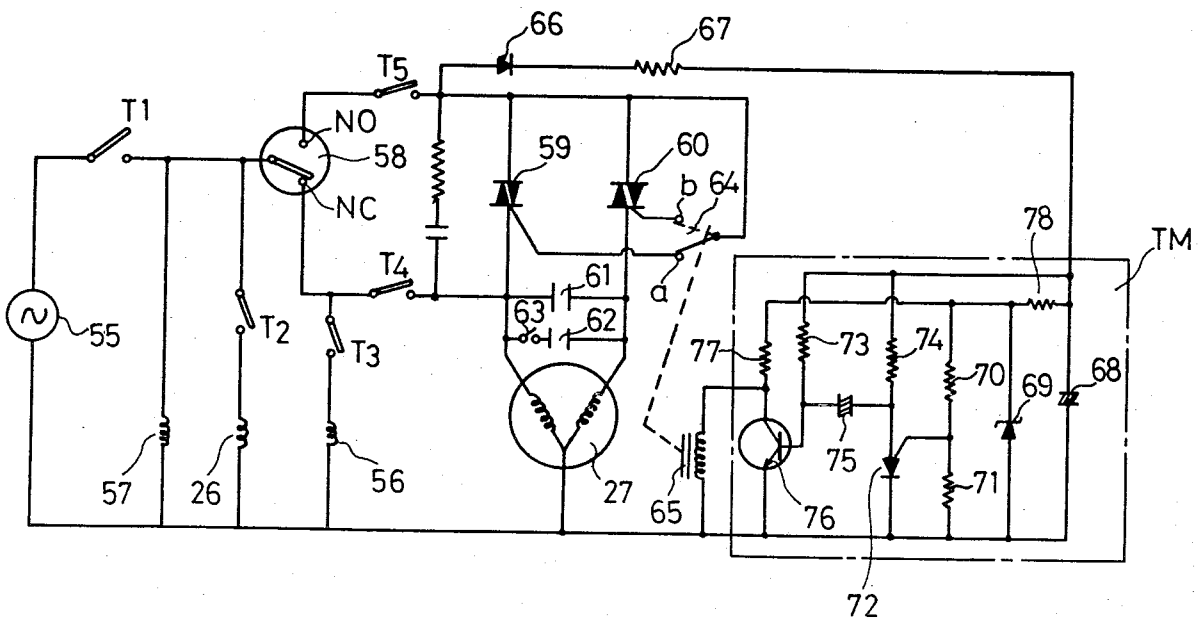
FIG. 7 is an electric circuit diagram used for the agitator-type washing machine.
Figure 8:
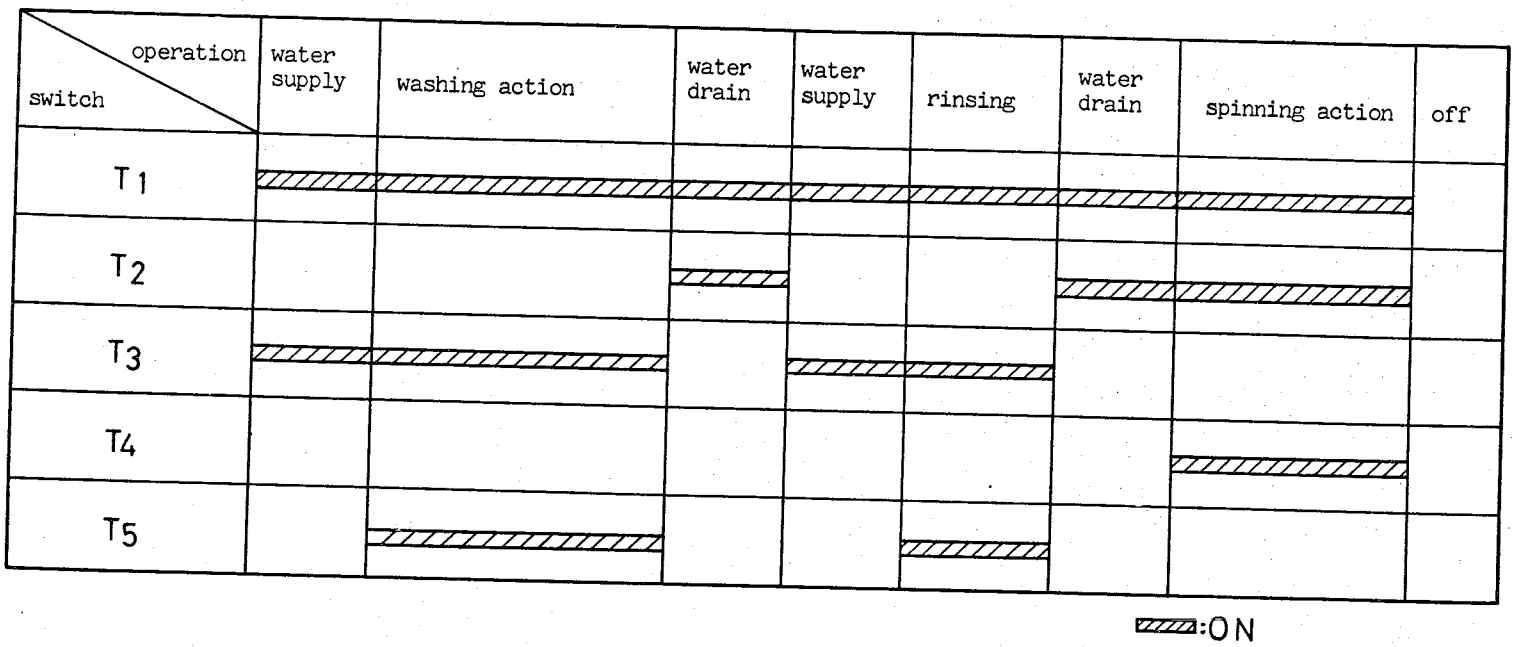
FIG. 8 is a time chart showing the operation of various parts of the agitator-type washing machine.

An electric circuit used for the agitator-type washing machine and the operation thereof are elucidated in the following by referring to FIGS. 7 and 8. FIG. 7 shows such an electric circuit. FIG. 8 shows a time chart of the operation by the electric circuit of FIG. 7. Electric power is supplied by a power source 55. A timer motor 57 is connected to the power source 55 through a first switch $T_1$. The magnet 26 of the drain valve 25 and a second switch $T_2$ are connected in parallel to the timer motor 57. A magnet 56 of a water supply valve (not shown) and a third switch $T_3$ are also connected in parallel to the timer motor 57 through one fixed terminal NC of a water level switch 58. During a while the magnet 56 of the water supply valve is actuated, water supply to the inner basket 15 and the tub 34 is made.

The magnet 26 of the drain valve 25 controls the position of the clutch lever 23. The timer motor 57 is for counting operation time of several actions of the washing machine. The water level switch 58 is for detecting the water level in the inner basket 15 and the tub 34. Bidirectional rectifier elements 59 and 60 such as Triac (trade name of General Electric Company) are respectively connected in series to a pair of coils of the motor 27 for controlling the rotational direction of the motor 27. Capacitors 61 and 62 are for starting a driving of the motor 27. The capacitor 62 in the electric circuit of FIG. 7 is disconnected by means of a switch 63 when the rotational speed of the motor 27 reaches a predetermined number of revolutions. Detection of the number of revolutions of the motor 27 can be made by a known detection control means employing a centrifugal clutch, an electric circuit comprising a light emitting diode and a photo transistor, or a detection means comprising a magnet and a Hall device. The electric circuit of FIG. 7 further comprises a fourth switch $T_4$ for the spinning action and a fifth switch $T_5$ for the washing action, a change-over switch 64 for changing turning directions of the motor 27, a relay 65, a diode 66, a resistor 67 and a C-R timer circuit TM. The C-R timer circuit comprises electrolytic capacitors 68 and 75, a Zener diode 69, resistors 70, 71, 73, 74, 77 and 78, a programmable unijunction transistor (hereinafter referred to PUT) 72, and a transistor 76.

A sequential control operation of the agitatortype washing machine with the electric circuit of FIG. 7 is elucidated in detail in the following. When a timer (not shown) is set by a known program switch means of the timer, the first switch $T_1$ is switched on, thereby actuating the timer motor 57. A travelling terminal of the water level switch 58 is connected to the fixed terminal NC thereof at this moment when the tub 34 is not yet filled with water. Then, as a small time passes, the third switch $T_3$ is closed by the timer, and the magnet 56 of the water supply valve is actuated thereby supplying water to the inner basket 15 and the tub 34. When the water level in the inner basket 15 and the tub 34 reaches a predetermined level, then the travelling contact of the water level switch 58 is thrown to the other terminal NO thereof. At this moment, by the disconnection of the third terminal $T_3$ the water supply is stopped, and then the fifth switch $T_5$ is closed, thereby actuating the washing action of the washing machine.

The control operation by the electric circuit of FIG. 7 in the washing action is as follows: The change-over switch 64 is repeatedly changed-over at a predetermined short time intervals and the bi-directional rectifier elements 59 and 60 are alternatively actuated in order to obtain the reciprocating motion of the motor 27. The actuation of the change-over switch 64 is made by the relay 65. Cycle of the change-over operation of the change-over switch 64 is controlled by the C-R timer circuit TM. The operation of the relay 65 controlled by the C-R timer circuit TM is as follows.

Power source voltage is converted by the diode 66, the resistor 67 and the electrolytic capacitor 68 into smoothed DC voltage. The Zener diode 69 is for obtaining a constant voltage value. The resistors 70 and 71 connected in parallel to the Zener diode 69 are for applying operation voltage to the transistor PUT 72. The transistor 76 is for actuating the relay 65. When the fifth switch $T_5$ is closed, the electrolytic capacitor 75 is gradually charged with the smoothed DC voltage through the resistor 74, and the charge current flows from the base to the emitter of the transistor 76. Accordingly, current flows from the collector to the emitter thereby turning on the transistor 76. At this moment, the relay 65 is not actuated and the changeover switch 64 is thrown to the terminal a thereby actuating the bi-directional rectifier element 59. Then, the motor 27 rotates in a first direction (e.g. clockwise direction). After a while, the transistor PUT 72 is actuated when the charging voltage of the capacitor 75 surpasses the operation voltage of the transistor PUT 72, and then current due to the charges stored in the electrolytic capacitor 75 flows through the transistor PUT 72 in the direction from the anode to the cathode thereof thereby decreasing the charge voltage of the electrolytic capacitor 75. During the discharge of the electrolytic capacitor 75, the base current of the transistor 76 is cut off and the transistor 76 is turned off. Accordingly, the relay 65 is actuated thus throwing the travelling contact of the change-over switch 64 to the terminal b, and hence the bi-directional rectifier element 60 is turned on. Therefore, the motor 27 rotates in the opposite direction to the first direction. The rotational motion of the motor 27 is thus controlled by the electric circuit of FIG. 7.

In case that the voltage of the power source 55 is increased to a higher value, the relay 65 is more frequently switched on and off. This is because the electrolytic capacitor 75 is more quickly charged due to the higher DC voltage, while the operation voltage of the transistor PUT 72 is kept constant by the Zener diode 69. Accordingly, the rotational direction of the motor 27 becomes to be reversed at a shorter period. On the contrary, when the voltage of the power source 55 is decreased to a lower value, the relay 65 is less frequently switched on and off because the electrolytic capacitor 75 is more slowly charged due to the lower D.C. voltage. Furthermore, time periods of charging and discharging the electrolytic capacitor 75 are controllable by the resistors 73 and 74. This means that the charging time period can be set longer than the discharging time period, and vice versa. Therefore, the relay 65 is change-over in a modified way, where the change-over from the terminal a to the terminal b can be made in a shorter time than the counterpart operation from the terminal b to the terminal a, and vice versa. Accordingly, the rotational time periods for the first rotational direction and the opposite direction thereto can be made different from each other, thereby generating a rotational angle difference between two rotational directions of the motor 27.

As described above, the motor 27 reciprocatively rotates by changing the rotational directions in a short time in the washing action. The reciprocating rotation of the motor 27 is transmitted to the input shaft 10 via the second metal coupling 31, the resin insulation means 32 and the first metal coupling 13. In the washing action, the magnet 26 of the drain valve 25 is not actuated and the clutch lever 23 holds the boss 22. Therefore, the spring 20 does not bind the sleeve 11. The speed of the rotary motion of the input shaft 10 is reduced by the reduction gear means 7, and torque generated by the rotary motion of the input shaft 10 is multiplied by the planetary gear mechanism thereby generating large torque at the output part 8 of the reduction gear means 7 and reciprocatively rotating the agitator 6 via the first shaft 5.

Rinse Operation of the Washing machine

First, the second switch $T_2$ is closed and the magnet 26 of the drain vlave 25 is actuated. Accordingly, the water in the inner basket 15 and the tub 34 drains through the drain hose 49. When the level of the residue water in the tub 34 sufficiently lowers, the travelling contact of the water level switch 58 is thrown to the terminal NC and the third switch $T_3$ is closed. Then the magnet 56 of the water supply valve (not shown) is actuated thereby supplying water to the inner basket 15 and the tub 34. After the water supply stops, the rinse action is made in the similar manner to the abovementioned washing action. After the rinse action, the second switch $T_2$ is closed and the magnet 26 of the drain valve 25 is actuated. Accordingly, the water in the inner basket 15 and the tub 34 drains through the drain hose 49. When the level of the residue water in the tub 34 sufficiently lowers, the travelling contact of the water level switch 58 is thrown to the terminal NC and the fourth switch $T_4$ is closed thereby starting the spinning action.

The control operation by the electric circuit of FIG. 7 has nothing to do with the bi-directional rectifier elements 59 and 60, and the C-R timer circuit TM in the spinning action. The motor 27 continuously rotates in one direction at a high spinning speed. The switch 63 is switched off, when the rotational speed of the motor 27 reaches the predetermined number of revolutions in the spinning action. The switch 63 is closed at the starting time of the spinning action as well as the washing action and the rinse action in the operation of the agitator-type washing machine in accordance with the present invention.

In the spinning action, the one-way rotation of the motor 27 is also transmitted to the input shaft 10 via the second metal coupling 31, the resin insulation means 32 and the first metal coupling 13. This time, the magnet 26 of the drain valve 25 is actuated and the clutch lever 23 is not engaged with the boss 22. Thus, along with the rotational movement of the sleeve 11, the bose 22 rotates a little due to the frictional force thereby making spring 20 bind the sleeve 11 and the lower part 18' of the second portion 18 of the gear box 19. Accordingly, the high speed spinning rotation is transmitted to the inner basket 15 via the shaft 14. At the same time, the agitator 6 rotates at the same high speed as that of the inner basket 15. Therefore, the washing objects in the inner basket 15 are subject to the spinning action thus dehydrating the water by centrifugal force. When the agitator 6 rotates at the high speed, a braking means (not shown) prevents the rotational movement of the second portion 18 of the gear box 19. The dehydrated water drops to the bottom of the tub 34 through the holes 44, and it drains through the drain hose. After the spinning action ends, the first switch $T_1$ is switched off and the overall sequential operation of the washing machine completes.

Figure 9:
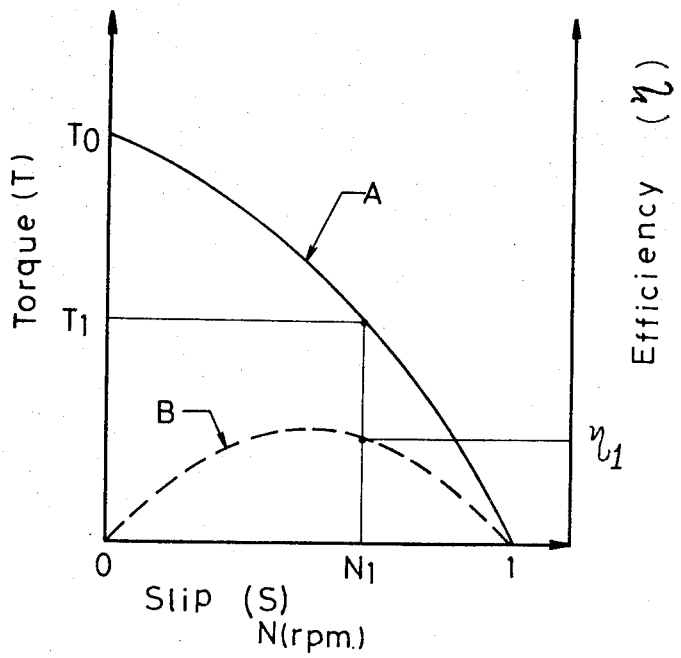
FIG. 9 is a graph showing characteristic curves of torque (T) and efficiency ($\eta$) versus slip (number of revolutions) of the motor of FIG. 4.

The agitator-type washing machine in accordance with the present invention has the following distinctive features:

(1) The planetary gear mechanism is employed for the speed reduction of reciprocating motion of the motor 27 in the washing action. By the use of the reduction means, the motor is used at a high speed rating which produces a higher efficiency of the motor 27 in comparison with low speed rating use in the conventional reciprocating direct-coupled motor. FIG. 9 is a graph showing characteristic curves A and B of torque (T) and efficiency ($\eta$) versus slip or number of revolutions N ($\gamma$pm) of the motor 27. As shown by the curve B of FIG. 9, a high efficiency of the motor 27 is obtainable at a number of revolutions $N_1$ than at a very low speed. Since the motor 27 is used in a high efficiency, and a large torque is obtainable by the reduction gear means 7 as shown by the curve A of FIG. 9, it is not necessary to use a motor of high capacity. Besides, large torque required for reversing the direction of the revolution of the motor 27 can be reduced by utilizing the back lashes of the reduction gear means 7. Therefore, the starting action of every reciprocating motion of the agitator 6 become gentle thereby reducing the damages of the washing objects during the washing action.

(2) The rotary angles in the two opposite directions can be made different from each other. Therefore, it is possible to slowly rotate the agitator in a specified direction in addition to the reciprocating rotary motion in the washing action. This results in that while the washing objects are washed reciprocatively, they are drived in one direction. By means of such movement, the washing objects are washed uniformly thereby attaining a high efficiency of the washing action.

(3) Installation of the motor shaft 30 and the input shaft 10 becomes easy by employing the elastic resin insulation means 32 for connection of the two shafts. There arise no problems, even though the center line of the motor shaft deviates a little from that of the input shaft 10. The height of the resin insulation means 32 is L as shown in FIG. 5 higher than those of the first metal coupling 13 and the second metal coupling 31. Accordingly, two metal couplings 13 and 31 are electrically isolated thus improving the insulation of the motor 27. In addition, the resin insulation means 32 is elastic and absorbs the shocks when the rotary direction of the motor 27 is reversely and repeatedly changed during the reciprocation action of the washing action. Accordingly, the operation noise can be diminished and life time of the reduction gear means can be prolonged.

Figure 10:
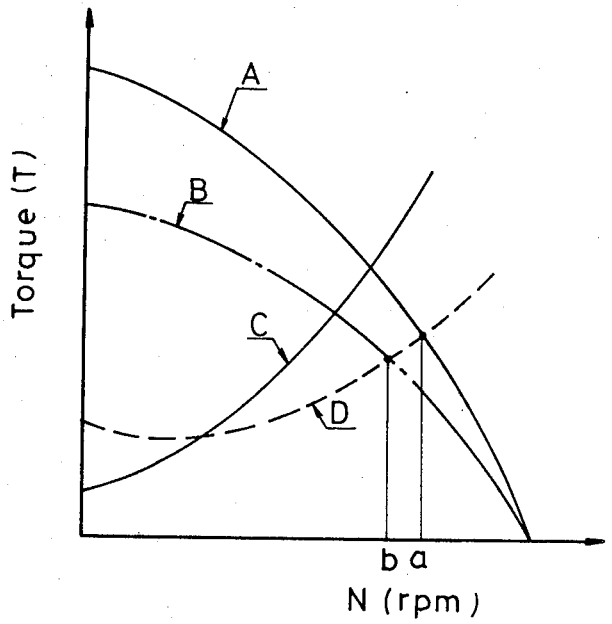
FIG. 10 is a graph showing characteristic curves of torque (T) versus number of revolutions (N) of the motor used for a washing action and a spinning action.

(4) There are several advantages in the circuit configuration where the capacitors 61 and 62 are used and the capacitor 62 is disconnected by the switch 63. FIG. 10 is a graph showing characteristic curves A, B, C and D of torque T versus number of revolutions N (rpm) of the motor 27. The curve A is obtained when two capacitors 61 and 62 are used. The curve B is obtained when the capacitor 61 is used alone. The curve C is a load curve in the washing action and the curve D is a lead curve in the spinning action. Suppose that the capacitor 62 is not disconnected in the spinning action, the rotational speed of the inner basket would be that indicated by the point a (correspoinding to the cross point of the curves A and D), which amounts to 1,000 rpm in our experimental results. This value is extermely large leading to undesirable irregular vibration problems. It is possible to decrease the rotaional speed of the motor 27 by turning off the switch 63 from the value at the point a to a vlaue at a point b (corresponding to the cross point of the curves B and D). Therefore, it is possible to minimize irregular oscillation of the inner basket 15. In addition, acceleration rate of the inner basket 15 is high since the switch 63 is closed at the start of the spinning action thereby generating large torque for the shaft 14. This means that the spinning action of the inner basket 15 can pass the critical resonance speed rapidly.

Figure 11:
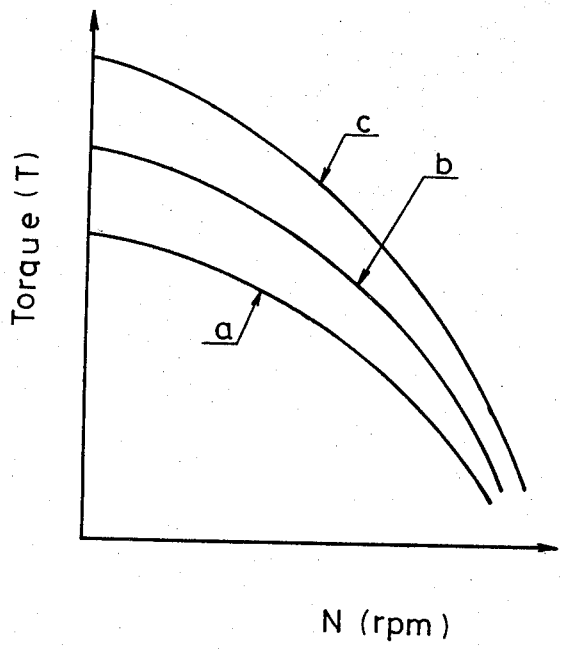
FIG. 11 is a graph showing characteristic curves of torque (T) versus number of revolutions (N) of the motor for different power source voltage.
Figure 12:
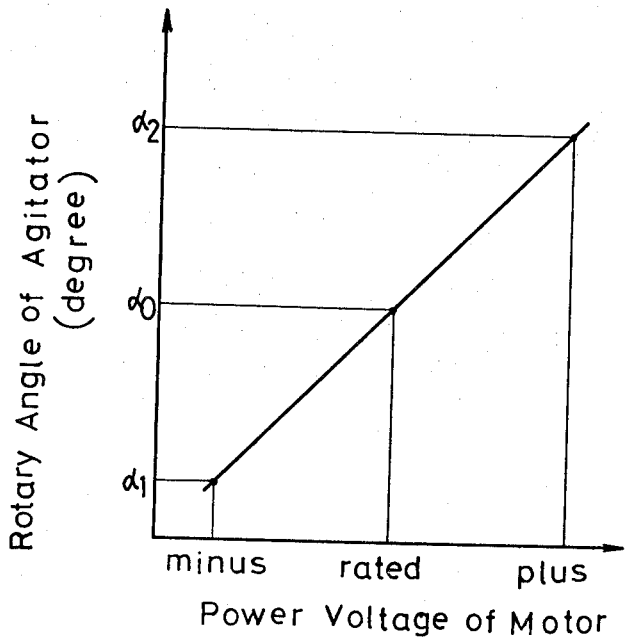
FIG. 12 is a graph showing a relationship between the power source voltage and a rotary angle of an agitator when the agitator reciprocatively rotates within a constant angle range.

(5) There are the following advantages in that the time period of the reciprocating motion of the motor 27 is dependent on the power source voltage. FIG. 11 is a graph showing characteristic curves of torque T versus number of revolutions N (rpm) of the motor 27 for different power source voltage, where a curve a is obtained for a lower voltage value and a curve c for a higher voltage value, respectively. Torque of the motor 27 generally increases in proportion to the square of power source voltage variation. A curve b is obtained for a rated power source voltage. FIG. 12 is a graph showing a relationship between the power source voltage and the rotary angle of the agitator when the agitator reciprocatively rotates within a constant angle range. The rotary angle of the agitator 6 increses when the power source voltage increases.

Figure 13:
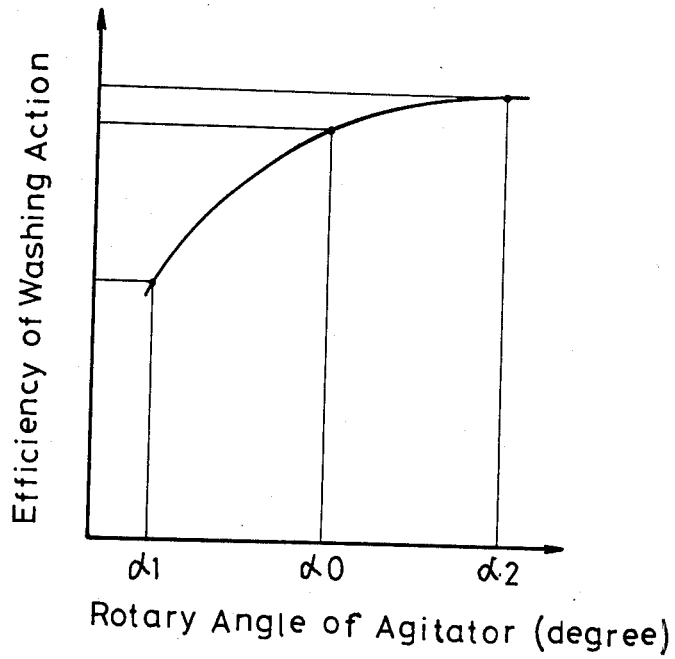
FIG. 13(*a*) is a graph showing a relationship between the rotary angle of the agitator and an efficiency of the washing action.
Figure 13:
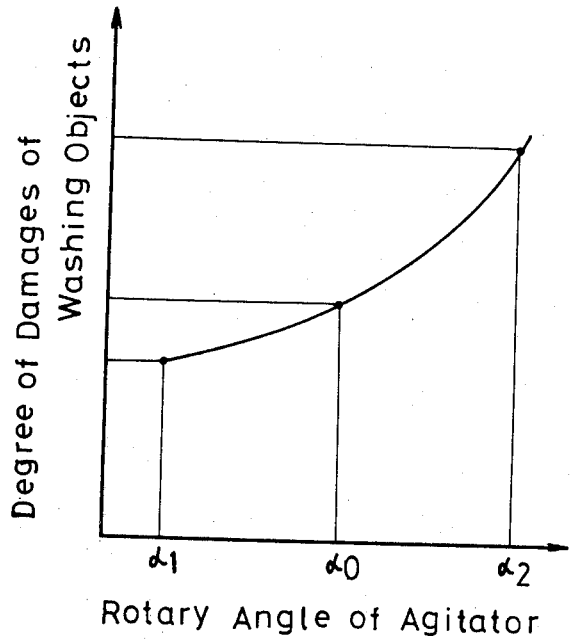

FIG. 13(*a*) is a graph showing a relationship between the rotary angle of the agitator and an efficiency of the washing action. FIG. 13(*b*) is a graph showing a relationship between the rotary angle of the agitator 6 and degree of damages of the washing objects. When the rotary angle of the agitator 6 increases at $\alpha_2$, the washing objects are more rapidly agitated thereby improving the efficiency of the washing action, but the improvement is rather small. On the other hand, by the increase of the angle, the damages of the washing objects greatly increase. When the rotary angle of the agitator 6 decreases at $\alpha_1$, the washing objects are slightly gently agitated thus slightly decreasing the efficiency of the washing action, while this time the damages of the washing objects greatly decrease.

When the power source voltage varies, the rotary angle of the agitator 6 is affected if the time period between the reciporcating motion of the motor 27 is held constant. This is not advantageous for the washing action. In the agitator-type washing machine in accordance with the present invention, the electric circuit is devised in such a manner that the rotary angle of the agitator 6 is automatically held almost constant at $\alpha_0$ regardless of variation of the power source voltage. Therefore, the optimum designed characteristics consisting of an elaborated comination of efficiency of the washing action and the damage of washing objects can be obtained. Therefore, the damages of the washing objects can be effectively prevented.

What we claim is:

1. An agitator-type washing machine comprising a washing tub, a spin basket rotatably disposed in said washing tub, a reciprocal agitator rotatably disposed in said spin basket, a spin basket shaft rotatably journalled to said washing tub and on which said spin basket is mounted, an agitator shaft rotatably journalled in and held coaxially to said spin basket shaft, an axial-airgap motor having a motor shaft, a reduction gear having an input shaft and an output shaft, said input shaft being connected to said motor shaft and said output shaft being connected to said agitator shaft, a clutch having an input shaft and an output shaft, said input shaft being connected to said motor shaft and said output shaft connected to said spin basket shaft, motor control circuit means for changing motor operation between a washing mode, to drive said axial-airgap motor reciprocatingly, and a spinning mode to drive said axial-airgap motor continuously in one direction, and interlocking means for interlocking said motor control circuit means with said clutch in a manner that, when said clutch is disconnected, said motor control circuit means is changed to said washing mode.

2. An agitator-type washing machine in accordance with claim 1, wherein said reduction gear includes a gear case encasing an annular-shaped internal gear therein, a plurality of planetary gears rotatably secured to planetary gear shafts and in driving engagment with said annular-shaped internal gear, a sun gear in driving engagment with said plural planetary gears and secured to said motor shaft, and an output member secured to said planetary gear shafts.

3. An agitator-type washing machine in accordance with claim 1, wherein said axialairgap motor includes two rotational angles of different rotational directions.

4. An agitator-type washing machine in accordance with claim 1, wherein said motor control circuit means includes at least a capacitor connected to a motor winding and a switch to vary the capacitance value of said capacitor.

5. An agitator-type washing machine in accordance with claim 1, wherein said motor control circuit means comprises a C-R timer circuit having an output terminal, a relay connected to said output terminal of said C-R timer circuit, two bi-directional rectifier elements each including control gates and switch means operated by said relay for controlling which of said bi-directional rectifier elements is actuated.

6. An agitator-type washing machine in accordance with claim 5, wherein said C-R timer circuit includes capacitor means for supplying operating voltages and resistor means for controlling the time constant of the charging and discharging of said capacitor means for actuating said two bi-directional rectifier elements in a predetermined manner.

7. An agitator-type washing machine in accordance with claim 1 further including revolution coupling means for connecting said motor shaft to said reduction gear input shaft, said revolution coupling means comprising a cross-shaped coupling piece made of an insulating resin, a pair of coupling means having two protrusions respectively, said pair of coupling means engaging each other by means of four protrusions of said cross-shaped coupling piece so that said motor shaft and said input shaft of said reduction gear are electrically isolated from each other.

* * * * *